US009858907B2

(12) United States Patent
Racine et al.

(10) Patent No.: US 9,858,907 B2
(45) Date of Patent: Jan. 2, 2018

(54) METHOD OF GRIPPING A STRIKING APPARATUS

(71) Applicants: Daniel Paul Racine, Charlton, MA (US); Thomas Richard Racine, II, Oxford, MA (US)

(72) Inventors: Daniel Paul Racine, Charlton, MA (US); Thomas Richard Racine, II, Oxford, MA (US)

( * ) Notice: Subject to any disclaimer, the term of this patent is extended or adjusted under 35 U.S.C. 154(b) by 330 days.

(21) Appl. No.: 14/634,151

(22) Filed: Feb. 27, 2015

(65) Prior Publication Data

US 2016/0249697 A1 Sep. 1, 2016

(51) Int. Cl.

| | |
|---|---|
| ***A41D 13/08*** | (2006.01) |
| ***G10G 5/00*** | (2006.01) |
| ***A44C 9/00*** | (2006.01) |
| ***G10D 13/00*** | (2006.01) |

(52) U.S. Cl.

CPC ..... *G10G 5/005* (2013.01); *A41D 13/087* (2013.01); *A44C 9/0076* (2013.01); *G10D 13/003* (2013.01)

(58) Field of Classification Search

CPC ..... A41D 13/0015; A41D 19/01547; A41D 19/00; A41D 13/087; A63B 71/146; A61B 19/04

USPC .... 2/69, 161.3, 161.8, 163, 161.7, 161.5, 17

See application file for complete search history.

(56) References Cited

U.S. PATENT DOCUMENTS

| | | | | | |
|---|---|---|---|---|---|
| 1,863,960 | A * | 6/1932 | Aronson | A41D 13/087 | 128/892 |
| 3,365,108 | A | 1/1968 | Giba | | |
| 3,859,887 | A | 1/1975 | Buchanan | | |
| 4,476,768 | A | 10/1984 | Willis | | |
| 4,719,836 | A | 1/1988 | Baumgart | | |
| 297,546 | A | 9/1988 | Seals | | |
| 4,881,275 | A * | 11/1989 | Cazares | A63B 71/148 | 2/161.1 |
| 5,079,776 | A * | 1/1992 | Crawford | A63B 71/141 | 2/162 |
| 5,370,030 | A | 12/1994 | Home | | |
| 5,577,272 | A * | 11/1996 | Fisher | A41D 13/087 | 2/163 |

(Continued)

FOREIGN PATENT DOCUMENTS

WO WO2005/094361 10/2005

OTHER PUBLICATIONS

Author: Georg, Date Mar. 1, 2013 Stretching Rubber Bands Understanding Hooke's Law http://c21.phas.ubc.ca/sites/default/files/rubber_band_write_up.pdf.

(Continued)

*Primary Examiner* — Tejash Patel

(74) *Attorney, Agent, or Firm* — The Patent Practice of Szmanda & Shelnut LLC; Charles R. Szmanda; James G. Shelnut

(57) ABSTRACT

This application for patent discloses is a method of improving the grip on a striking apparatus, including the step of: providing a plurality of elastomer bands having a size suitable to fit snugly on the fingers, said elastomer bands being characterized in that: (a) they exhibit a first substantially linear force constant through an initial range of stretch and a second substantially linear force constant through a subsequent range of stretch; and (b) the first substantially linear force constant is less than the second substantially linear force constant.

13 Claims, 5 Drawing Sheets

(56) References Cited

U.S. PATENT DOCUMENTS

| | | | | |
|---|---|---|---|---|
| 6,363,535 | B1 * | 4/2002 | Landis | A41D 19/01547 2/161.4 |
| 7,435,889 | B1 | 10/2008 | Heidt | |
| 7,473,836 | B2 | 1/2009 | Barke | |
| 7,595,442 | B2 | 9/2009 | Grover | |
| 7,735,153 | B1 * | 6/2010 | Romiti | A41D 19/01558 2/161.6 |
| 8,443,462 | B1 * | 5/2013 | Eugene | A41D 13/087 2/16 |
| 9,259,062 | B2 * | 2/2016 | Martinez | A44C 9/0092 |
| 2002/0002895 | A1 | 1/2002 | Zbrzezny | |
| 2006/0027073 | A1 | 2/2006 | Richard | |
| 2006/0027076 | A1 | 2/2006 | Barke | |
| 2013/0023352 | A1 * | 1/2013 | Percy | A63B 69/0057 473/212 |
| 2014/0304886 | A1 * | 10/2014 | Eugene | A41D 13/087 2/163 |
| 2015/0251076 | A1 * | 9/2015 | Staton | A63B 71/143 2/161.1 |

OTHER PUBLICATIONS

Exploring the thermodynamics of a rubber band David Roundy and Michael Rogers Citation: Am. J. Phys. vol. 81, 20 (2013); doi: 10.1119/1.4757908.

* cited by examiner (Conventional Elastomer Band)

METHOD OF GRIPPING A STRIKING APPARATUS

FIELD OF THE INVENTION

The present application for patent is in the field of striking apparatuses such as drumsticks and more specifically related to an appliance to aid in gripping the striking apparatus.

BACKGROUND

Many musical groups of today such as marching bands, dance bands, rock bands, and the like, present musical performances such as in parades, during half-time activities of an athletic events, during a pop, rock, or jazz musical performance, or the like. A drummer or a percussionist, (herein, interchangeably denoted by either term, to the extent that they use striking devices such as drumsticks) and the beat which they provide to a musical group, are indispensable to that group. The drumbeat becomes the basic beat of the music. The rhythm of the dream may at times stand alone in a musical composition, but a composition is seldom without the rhythmic accompaniment of a drum. The main contribution and his playing to music are aural. However, the contribution is also visual. The flash of the spinning drumsticks and the rhythmic waving of the drummer's hands, arms, and the whole body are part of the drummer's presence.

When performing with a standard striking apparatus the drummer may have a preferred grip location on the shaft. This position is what produces the optimum sound during the performance. While playing, the drummer frequently loses the preferred grip and has to regain the original position. Occasionally, the drumstick may slip completely out of the drummer's hand. The problem becomes worse if the drummer's hand is sweaty. This slippage is due mainly to centrifugal or inertial forces on the drumstick while in motion. Several attempts have been made to assist in gripping a drumstick.

For example, one such attempt may be found in U.S. Design Pat. No. 297,546 to Seals which shows a drumstick having a large wrist band attached thereto. U.S. Pat. No. 3,365,108 to Giba discloses a retaining device for drumsticks wherein a ring which is worn on a finger of the drummer's hand is connected to the drumstick by a short, flexible, and freely swiveling connection.

A further example is provided by U.S. Pat. No. 4,719,836 to Baumgart, which discloses a drumstick on the left hand having three recesses in the peripheral region of the short flexor of the thumb, another for the ring finger, and the third for the middle finger. U.S. Pat. No. 4,476,768 to Willis discloses a drumstick having a non-bulbous tip and a grip portion to facilitate holding of the stick. The end of the stick is sharply tapered, ending in a point.

A still further example is provided by U.S. Pat. No. 3,859,887, to Buchanan, which discloses a drumstick having "a gripping member pivotally attached to said drumstick in the intermediate region adjacent to the balance area, said drumstick being freely pivotal with respect to said gripping member."

A still further example is provided by P.C.T App. No. WO 2005/094361 by Richard, which discloses an ergonomic drumstick that "includes a plurality of rings forming ridges configured to circumferentially encompass a drumstick, the plurality of rings located non-equidistant from each other on the drumstick such that the rings ergonomically conform to the grip of a hand, the rings made from a softer material than the drumstick."

While the above devices generally address the issue of improved gripping of a drumstick, they do not provide a convenient and inexpensive means for improved grip on a variety of unmodified ordinary striking devices that include drumsticks, mallets, brushes, hammers, metal rods, specialty striking apparatuses, bows and the like. Therefore, there remains a need for a method of improving a percussionist's grip on a striking apparatus that does not require modification of the striking apparatus in any way.

DETAILED DESCRIPTION OF THE DRAWINGS

Figure 1:
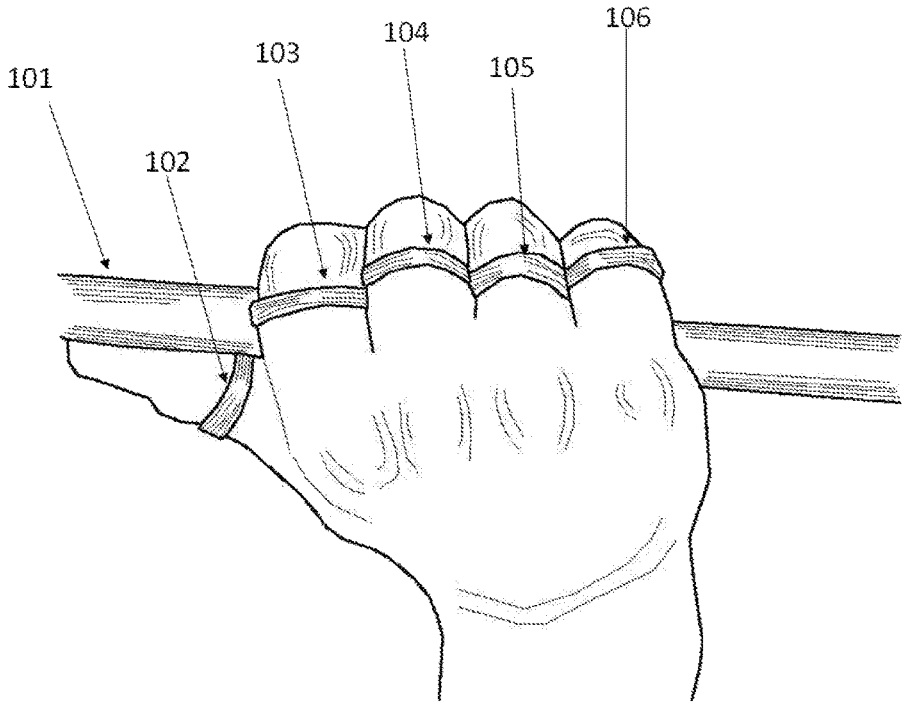
FIG. 1 illustrates a hand holding an ordinary drumstick using the method disclosed herein.

FIG. 1 depicts an example of how the elastomer bands are deployed for assisting grip to the striking device (in the illustration, a drumstick, 101) when in use. The elastomer bands of the present disclosure, 102-106 are placed around the fingers and the thumb in the manner shown.

Figure 2:
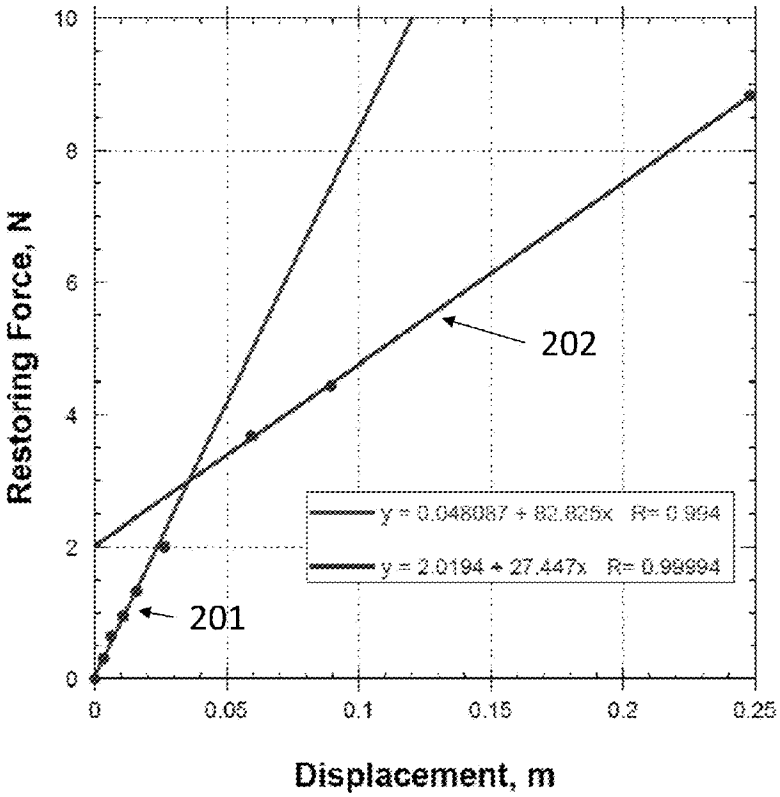
FIG. 2 illustrates a plot of the restoring force vs. the stretch displacement of an ordinary elastomer band.

FIG. 2 shows a plot of the restoring force vs. the stretch displacement of a typical elastomer band. The data depict a first substantially linear force constant through an initial range of stretch, 201, and a second substantially linear force constant through a subsequent range of stretch, 202. The empirical data points were adapted from http://c21.phas.ubc.ca/sites/default/files/rubber_band_write_up.pdf. The first substantially linear force constant through an initial range of stretch, 201, is calculated from a least squares fit to the first five data points to be about 83 N/m. The second substantially linear force constant through a subsequent range of stretch, 202, is calculated from a least squares fit to be about 27 N/m.

Figure 3:
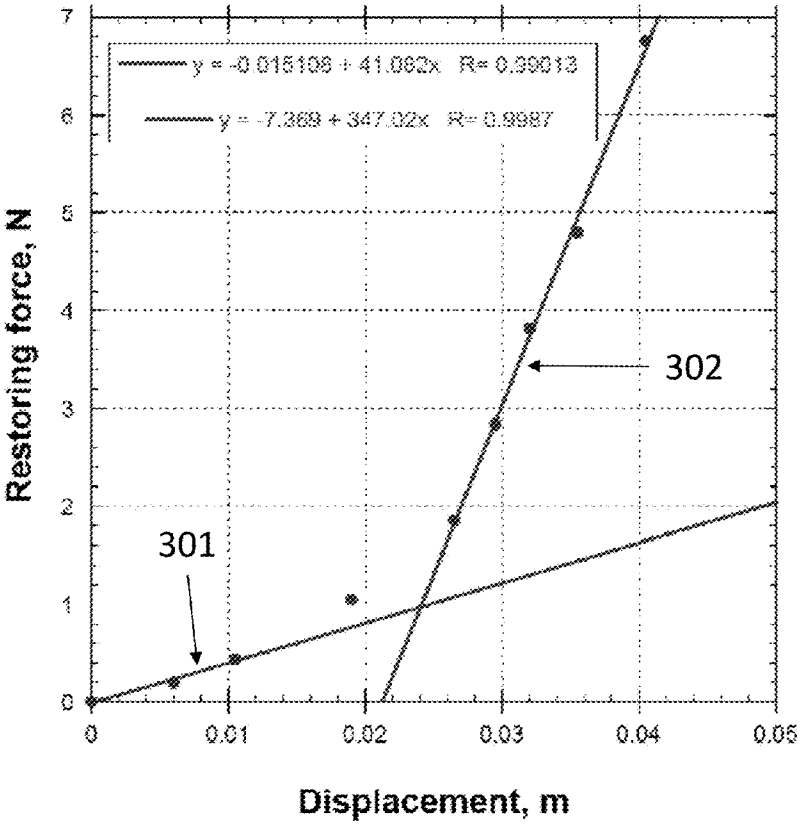
FIG. 3 illustrates a plot of the restoring force vs. the stretch displacement of an elastomer band described herein.

FIG. 3 shows a plot of the restoring force vs. the stretch displacement of an elastomer band disclosed herein. The first substantially linear force constant through an initial range of stretch, 301, is calculated from a least squares fit to the first five data points to be about 41 N/m. The second substantially linear force constant through a subsequent range of stretch, 302, is calculated from a least squares fit to be about 347 N/m.

Figure 4:
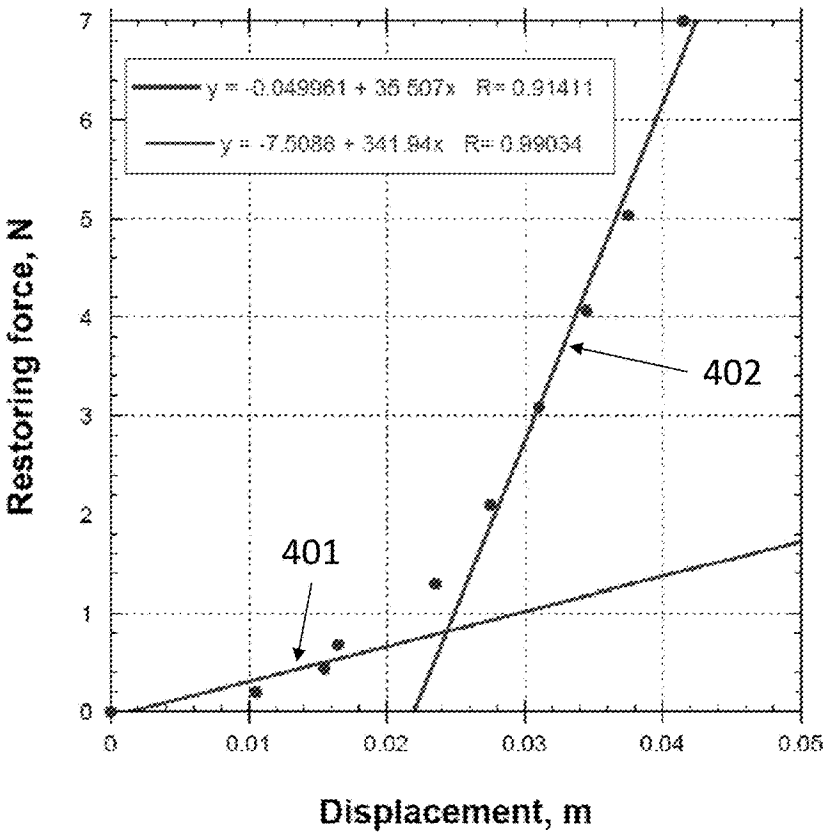
FIG. 4 illustrates a plot of the restoring force vs. the stretch displacement of an elastomer band described herein.

FIG. 4 shows a plot of the restoring force vs. the stretch displacement of an elastomer band disclosed herein. The first substantially linear force constant through an initial range of stretch, 401, is calculated from a least squares fit to the first five data points to be about 36 N/m. The second substantially linear force constant through a subsequent range of stretch, 402, is calculated from a least squares fit to be about 342 N/m.

Figure 5:
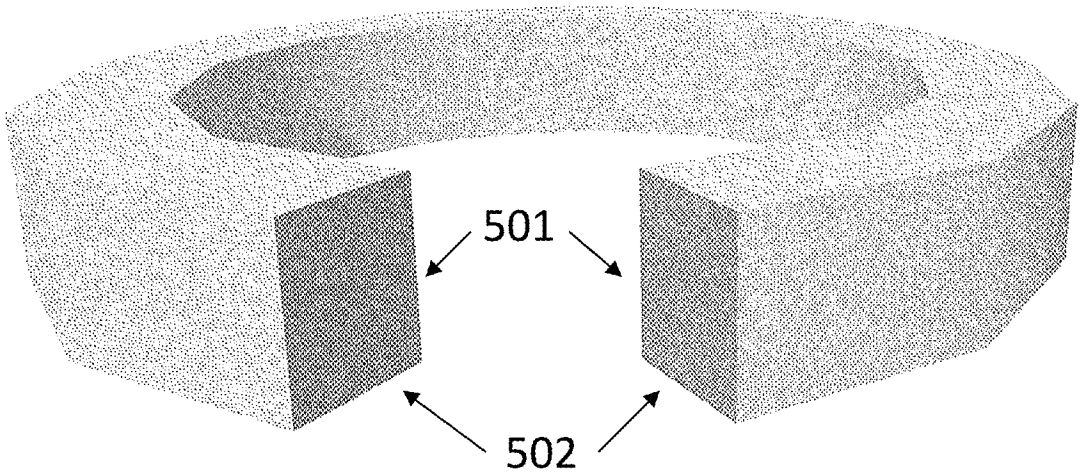
FIG. 5 illustrates a cutaway view of an elastomer band having an idealized generally rectangular cross section.

FIG. 5 illustrates a cutaway view of an elastomer band having an idealized generally rectangular cross section, with a selected height 501 and width 502.

DETAILED DESCRIPTION

As used herein, the conjunction "and" is intended to be inclusive and the conjunction "or" is not intended to be exclusive unless otherwise indicated or required by the context. For example, the phrase "or, alternatively" is intended to be exclusive.

As used herein, a "striking apparatus" may be any device that may be used to strike an object. In the context of use with a musical instrument, striking apparatuses may include, without limitation, drumsticks, mallets, brushes, hammers, metal rods, specialty striking apparatuses, bows and the like.

As used herein a "force constant" is understood as the as the ratio of the incremental force affecting an object to the incremental displacement caused by or causing the force, within a given range of stretch displacement. More precisely, it is the mathematical derivative of the force, F(x) with respect to the displacement, x, within a given range of stretch displacement. For example, given an applied incremental force of 0.01 Newton (kg m/sec$^2$) and a resulting incremental stretch displacement of an elastomer band of 0.001 meter (m) along the same axis as the incremental force, the force constant would be about 10 N/m. It is further understood that an elastomer band may exhibit two or more force constants through different ranges of stretch displacement. A substantially linear force constant is understood to be a ratio of force to displacement as defined above, wherein the displacement is selected over an approximately linear region of the curve of Force vs. stretch displacement as shown, for example, in FIGS. 2-4. Force constants may be ascertained by using a least-squares fit to obtain the slope.

As used herein, the term "perimeter elongation" is understood to mean the stretch displacement of an elastomer band, measured on the outer surface of the elastomer band. For example, in FIG. 1, the elastomer bands around the finger undergo some perimeter elongation via stretch displacement to fit around the fingers. A perimeter elongation of 50% denotes a perimeter size 150% of the original.

As used herein, the term "generally rectangular cross section" is understood to include cross sections of purely rectangular shape as well as cross sections having a distorted rectangular shape or cross sections having protrusions or other defects such as may occur during molding.

As used herein, the descriptor "exemplary" is understood to point to an example and is not necessarily intended to indicate preference.

As used herein, the term "(meth)acrylate" is understood to indicate that both acrylate and methacrylate are contemplated.

Disclosed herein is a method of improving the grip on a striking apparatus comprising: providing a plurality of elastomer bands having a size suitable to fit snugly on the fingers, said elastomer bands being characterized in that: (a) they exhibit a first substantially linear force constant through an initial range of stretch and a second substantially linear force constant through a subsequent range of stretch; and (b) the first substantially linear force constant is less than the second substantially linear force constant.

The number of elastomer bands suitable for applications disclosed herein may be 2 or more for each hand. Elastomer bands may be worn one per finger or the user may elect to use two or more per finger. Kits may be provided with any number of elastomer bands greater than two. For example, without limitation, it may be desirable to provide a kit having 15 or more elastomer bands per hand, to accommodate the use of 2 or more per finger, and to provide spare elastomer bands.

The elastomer bands of the current disclosure may be used to improve the grip on a number of striking devices; the plurality of elastomer bands discussed supra may be sized to fit snugly on fingers of different girth without cutting off blood circulation or otherwise causing injury or discomfort. For example and without limitation, the elastomer band may be substantially circular, having an outer diameter of between about 1 and 4 cm and an inner diameter of between about 0.3 and 3.6 cm. As a further example, and without limitation, the elastomer band may be substantially circular, having an outer diameter of between about 1.5 and 3.5 cm and an inner diameter of between about 0.9 and 2.9 cm. As a still further example and without limitation, the elastomer band may be substantially circular, having an outer diameter of about 1.8 cm and an inner diameter of about 1 cm. The shape of the elastomer band need not be substantially circular but may take any geometric shape having curved or flat sides or combinations thereof.

The height of the elastomer band may be between about 1 and about 50 mm and be selected to optimally improve the grip on the selected striking apparatus. Alternatively, the height of the elastomer band may be between about 1 and about 30 mm. For example, an elastomer band designed to assist the grip on a drumstick may have a height of between 1 and 6 mm. On the other hand, an elastomer band designed to assist the grip on a bow may have a selected height of between 1 and 10 mm. It is also contemplated that the elastomer bands described herein may assist holding other devices such as knives, golf clubs, steering wheels bicycle handle bars, weights and the like. As an example, the height of the elastomer band designed to grip a golf club optimally may be between 10 and 50 mm, depending on the finger length.

We have found, unexpectedly, that certain types of elastomer bands are more suitable for the gripping applications disclosed herein than others. When an elastomer band is stretched, it exerts a restoring force. Within a given range of stretch, i, the restoring force responds linearly to a stretch deformation, viz:

$$F_i = k_i x + b_i$$

where the force, $F_i$ is only defined within the i-th substantially linear region of stretch displacement, $k_i$ is the substantially linear force constant defined within linear region of the i-th linear range of stretch displacement as might be seen, for example in FIGS. 2-4, numbers 201-202, 301-302, and 401-402 and $b_i$ is the phenomenological intercept corresponding to the i-th linear range of stretch displacement.

Most ordinary latex rubber bands, having a latex elastomer or similar, have a first substantially linear force constant through an initial range of stretch and at least one other substantially linear force constant through a second or subsequent range of stretch. However, as shown in FIG. 2, the first substantially linear force constant, 201, about 82.8 N/m, in this example, is approximately 3 times greater than the second substantially linear force constant of 27.4 N/m, 202. Were this particular rubber elastomer band to be used for the application disclosed herein, the restoring force experienced by the user may be sufficiently strong (0.083 N-0.66 N with a displacement between 1 mm and 8 mm) to cut off the circulation in the finger, particularly after extended use.

The elastomer bands of this disclosure have initial force constants that are softer than subsequent force constants. For example, without limitation, in FIG. 3, the first substantially linear force constant, 301, is about 41.1 N/m, approximately 8.4 times smaller than the second substantially linear force constant of 347.0 N/m, 302. At stretch displacements between 1 mm and 8 mm, the forces experienced by a finger would be about 0.041 N to about 0.33 N, approximately half of the values for the rubber band, above. As a further non limiting example, in FIG. 4, the first substantially linear force constant, 401, is about 35.5 N/m, approximately 9.6 times smaller than the second substantially linear force constant of 341.9 N/m, 402. At stretch displacements between 1 mm and 8 mm, the restoring forces experienced by a finger would be about 0.036 N to about 0.28 N, less than half of the values for the rubber band above.

Initial linear force constants should be small enough so that restoring forces on the elastomer bands do not interfere with the circulation in the fingers or cause discomfort to the user. Empirically, it has been found that first substantially linear force constants of between about 10 and about 70 N/m accomplish this goal. Within this range, the first substantially linear force constant range of between about 20 and about 60 N/m is exemplary. Further, within the above range, the first substantially linear force constant range of between about 30 and about 50 N/m is also exemplary.

Further, elastomer bands of this disclosure have a subsequent substantially linear force constant, exhibited in a different range of stretch displacement that is greater than the first substantially linear force constant that is observed in the first range of stretch displacement. Without intending to be bound by theory, it is believed that the higher substantially linear force constant is imparted by a higher cross link density within the polymer matrix. This higher cross link density also imparts toughness and water resistance to the elastomer band and enables use through rigorous drumming or other activities that involve using a striking apparatus to strike an object. We have found that toughness can be evaluated using the ratio of the second or subsequent substantially linear force constant to the first substantially linear force constant; such that materials with larger ratios impart more toughness and water resistance to the elastomer band. Exemplary ratios range from about 2.0 to about 20.0. Within that range, further exemplary ratios range from about 5.0 to about 15.0. Further, exemplary ratios range from about 6.0 to about 12.0.

Forming the elastomer bands of this disclosure may be accomplished by molding a plastisol formulation, at elevated curing temperatures from about 140° C. to about 260° C. Within that range, from 160° C. to 240° C. may be used. Further within that range, from 170° C. to 200° C. may be used. The plastisol formulation is poured into a mold, cured in an oven at the desired temperature setting, allowed to cool and extracted from the mold. In addition to the plastisol formulation a hardener may be used to impart toughness and water resistance to the product elastomer band as described supra. If a hardener formulation is used, it is blended thoroughly with the plastisol formulation in the desired ratio, poured into a mold and cured as described above.

A plastisol is a liquid substance that can be converted into a solid or gelled plastic by heating. Plastisols comprise particles of one or more polymer materials dispersed in a nonvolatile liquid such as a plasticizer. Other additives may be blended into the plastisol formulation, which may also include the hardener. These include pigments, dyes, photo luminescent powders, fillers, extenders, rheological additives such as plasticizers, as well as solvents and heat stabilizers.

In accordance with the above, polymer materials include, without limitation, polymerized monomer repeat units such as vinyl halides, vinylidine halides, acrylonitrile, methacrylate esters, acrylate esters, vinyl ethers, vinyl esters, unsaturated hydrocarbons dienes, isoprenes, and the like. Further examples include copolymers comprising any of the foregoing monomers. Specific monomers include vinyl chloride, vinyl fluoride, vinyl bromide, vinyl acetate, vinyl propanoate, vinyl butanoate, vinylidine fluoride, vinylidine chloride, 2-chloro-1,1-difluoroethene, trichloroethylene, ethylene, propylene, styrene, substituted styrene, α-methyl styrene, α-chloro styrene, butadiene, isoprene, alkyl (meth)acrylate, wherein alkyl is a $C_1$-$C_{18}$ linear, or branched hydrocarbon group, acrylonitrile, vinyl methyl ether, vinyl ethyl ether, 1-chlorobutadiene, and alky acetate, wherein alkyl is a $C_1$-$C_{18}$ linear, or branched hydrocarbon group. Copolymers comprising any of the foregoing monomers are also contemplated.

Polymers comprising the foregoing listed monomers and other monomers include, without limitation, polyvinyl chloride, polyvinyl fluoride, a polyester, a polyamide, poly alkyl (meth)acrylate, vinyl polymers, modified alkyd polymers, an allyl diglycol carbonate polymer, a polybutadiene or substituted polybutadiene polymer, an unsaturated polyester, a polyimide, a silicone polymer, a silicone polyimide copolymer, or a combination comprising any of the foregoing.

The Plastisol formulation can be formed from a mixture of a powdered polymer material with a plasticizer. The powdered polymer material can comprise polyvinyl chloride, an acrylic polymer, a polyester, or other polymer listed above. The polymer material can be a homopolymer or a copolymer, or the powder can be a blend comprising several polymers such as PVC with an acrylic polymer.

Polyvinyl chloride (PVC) and acrylic polymers suitable for plastisol applications are typically emulsion-polymerized or suspension-polymerized. The average particle size of the powdered polymer material is usually in the range of 0.3 microns to 200 microns. Too small of a particle size may lead to storage instability and hence gelling upon storage with the plasticizers. Too large a particle size may, on the other hand, lead to incomplete plasticization and poor film integrity.

Both PVC homopolymers and copolymers having molecular weights ranging from 10,000 to 2,000,000 are applicable. Commonly used PVC copolymers are vinyl chloride-vinyl acetate copolymers. Other comonomers with PVC include vinylidene chloride, acrylonitrile, diethyl maleate, ethylene, propylene and other ester monomers.

Acrylic polymers can be homopolymers or copolymers prepared from methacrylate or aerylate-containing monomers. Useful molecular weights range from 40,000 to 2,000,000. Useful acrylic monomers include, for example, methyl acrylate and methacrylate, ethyl acrylate and methacrylate, n-propyl or isopropyl acrylate and methacrylate, butyl acrylate and methacrylate, 2-ethyl hexyl acrylate and methacrylate, cyclohexyl acrylate and methacrylate or hydroxyl alkyl acrylates and methacrylates, and the like. Exemplary polymers for this application include polymethyl methacrylate (PMMA) and copolymers of methyl methacrylate having up to 25 weight percent butylmethacrylate. Further exemplary polymers for this application include polymethyl methacrylate (PMMA) and copolymers of methyl methacrylate having up to 50 weight percent butyl methacrylate.

A wide variety of plasticizers suitable for PVC plastisols and acrylic plastisols is available. These include the phthalates, adipates, benzoates, azelates, sebacates, glutarates, glycerol esters, glycol esters, butyrates, oleates, alkyds, phosphates, carbonates, trimellitates, citrates, stearates, polymeric esters, epoxidized oils, epoxy tallates, amide esters, sulfonamides or terpenes.

Examples of specific plasticizers for PVC include, without limitation, dioctyl phthalate, diisooctyl phthalate, diisononyl phthalate, diisodecyl phthalate, butyl benzyl phthalate, dipropylene glycol dibenzoate, N-ethyl o,p-toluene sulfonamide, di(2-ethyl hexyl) adipate, diisodecyl adipate, acetyl tri-n-butyl citrate, epoxidized soybean oil, and trimethyl pentanediol diisobutyrate.

Examples of suitable plasticizers for acrylic polymers include, but are not limited to, dibutyl phthalate, diisobutyl phthalate, diisononyl phthalate, diisooctyl phthalate, diisodecyl phthalate, diamyl phthalate, dibenzyl phthalate, butylbenzyl phthalate, dimethoxy-ethyl phthalate, diethoxy-ethyl phthalate, dibutoxy-ethyl phthalate, dibenzyl toluene, tricresyl phosphate, diphenyloctyl phosphate, triphenyl phosphate, diethyleneglycol dibenzoate, dipropyleneglycol dibenzoate, dibenzyl benzoate, diphenyl ether, acetyl tributyl citrate and other plasticizers that are compatible and storage stable with the acrylic polymer material.

While phthalate esters are used in many plastisol formulations, they may be released into the environment and onto the skin. In typical plastisols, there is no covalent bond between the plasticizer and the polymer materials. Rather, the plasticizer is usually physically entrained in the plastic as a result of the heating process. Accordingly, when phthalate esters are used as plasticizers, people may be exposed to them as they diffuse out of the elastomer matrix. Concerns about adverse environmental and health effects of phthalate esters have led manufactures to use non phthalate plasticizers, which are contemplated for use herein, without intending any limitation on the claimed invention.

Hardeners for this application include, without limitation, epoxy-type resins, resols, alcoxymethyl melamine resins, alkoxymethyl glycoluril resins, alcoxymethyl guanamine resins, polyisocyanates, and polyanhydrides, used alone or in combination. Hardeners may include short-chain and longer-chain bisphenol-A or bisphenol-F epichlorohydrin resins. Such epoxides are well known in the art and are described in Y. Tanaka, "Synthesis and Characteristics of Epoxides", in C. A. May, ed., Epoxy Resins Chemistry and Technology (Marcel Dekker, 1988). Examples include those epoxides disclosed in U.S. Pat. No. 5,599,855 Columns 5/6 to 6/20, incorporated by reference.

Various types of solvents and additives may be optionally used in the plastisol formulation. Examples of solvents include hydrocarbons (such as benzene, toluene, xylene, cyclohexane, mineral spirit, naphtha and the like); ketones (such as acetone, methyl ethyl ketone, methyl isobutyl ketone and the like); esters (such as ethyl acetate, n-butyl acetate, cellosolve acetate, ethyl lactate, propylene glycol methyl ether acetate and the like); and alcohols (such as n-butanol, isopropyl alcohol, octanol, isooctanol and the like). These solvents may be used individually or in combination.

Plastisol and hardener formulations are commercially available. For example, such materials may be obtained from the LureCraft Fisherman's Shop of Orland, Ind., or Jan's Netcraft of Maumee, Ohio.

Rheological measurements such as those in FIGS. 3-4 are made using a simple apparatus comprising a ruler, several two sided hooks, a small bag or pouch and an electronic scale. The elastomer band and ruler are suspended in close proximity on their respective hooks. The bag or pouch is suspended using a double sided hook from the elastomer band and the position, defined by a reference point on the double sided hook is measured with the ruler. The elastomer band is allowed to stretch isothermally as one or more small weighed objects are placed in the bag or pouch. Data, thus collected, are shown in FIGS. 3-4. Slopes, corresponding to the first and second substantially linear force constants, were obtained using separate least-squares fits to the data in the first and second ranges of stretch, as indicated in the figures. These experiments are illustrated by a paper entitled, "Stretching Rubber Bands: Understanding Hooke's Law" from the University of British Columbia, which may be obtained at http://c21.phas.ubc.ca/sites/default/files/rubber_band_write_up.pdf, from which the data of FIG. 2 were obtained. A further explanation of this method may be found in Roundy et al., Am. J. Phys. 81, 20, (2013).

EXAMPLES

Example 1

Plastic 500, extra strength plastisol, available from the LureCraft Fisherman's Shop of Orland, Ind., was poured into a mold for making elastomer bands to a depth of about 4.8 mm, said mold having an outer diameter of about 2.3 cm, and an inner diameter of about 1.3 cm. The mold was placed into a 350° C. oven for 20 minutes, taken out and allowed to cool. The resulting elastomer ring was extracted and tested with a drum stick as shown in FIG. 1. Elastomer bands of this example yielded a comfortable elastomer band that enabled improved grip but with poor durability.

Example 2

Similar to Example 1, except that the elastomer band was formed using a mixture of the Plastic 500 extra strength plastisol formulation (3.785, liters) and a hardener formulation, available as Hardener 1X102C, available from the LureCraft Fisherman's Shop of Orland, Ind. (0.237 liters). Elastomer bands of this example yielded a comfortable elastomer band that enabled improved grip and had improved durability.

Example 3

Similar to Example 2, except that 0.474 liters of the hardener formulation was used. Stretch displacement data for the resulting elastomer bands were shown in FIGS. 3-4. Elastomer bands of this example yielded a comfortable elastomer band that enabled improved grip and had excellent durability.

Example 4

Similar to Example 2, except that 0.711 liters of the hardener formulation was used. Elastomer bands of this example yielded a comfortable elastomer band for small finger sizes that enabled improved grip and had excellent durability. For larger finger sizes, the band was less comfortable.

Although the present invention has been shown and described with reference to particular examples, various changes and modifications which are obvious to persons skilled in the art to which the invention pertains are deemed to lie within the spirit, scope and contemplation of the subject matter set forth in the appended claims.

What is claimed is:

1. A method of improving the grip on a striking apparatus comprising: providing a plurality of elastomer bands having a size suitable to fit snugly on the fingers, said elastomer bands being characterized in that:

a. they exhibit a first substantially linear force constant through an initial range of stretch and a second substantially linear force constant through a subsequent range of stretch; and b. the ratio of the second substantially linear force constant to the first substantially linear force constant is between about 2.0 and about 20.0;

wherein the first substantially linear force constant and the second substantially linear force constant are measured along essentially the same line.

2. The method of claim 1 wherein each of the plurality of elastomer bands is sized so that, when in use, its perimeter elongation is no more than about 50% of its original perimeter.

3. The method of claim 1, further comprising placing the plurality of elastomer bands on each of a plurality of a percussionist's fingers.

4. The method of claim 1, wherein the first substantially linear force constant is between about 10 N/m and about 70 N/m.

5. The method of claim 4, wherein the first substantially linear force constant is between about 20 N/m and about 60 N/m.

6. The method of claim 1, wherein the ratio of the first substantially linear force constant to the second substantially linear force constant is between about 5.0 and about 15.

7. The method of claim 1, wherein the second substantially linear force constant is between about 150 N/m and about 400 N/m.

8. The method of claim 1 wherein the elastomer band comprises a polymer chosen from polyvinyl chloride, poly alkyl (meth)acrylate, wherein alkyl is a $C_1$-$C_{18}$ linear, or branched hydrocarbon group, a vinyl ether polymer, a vinyl ester polymer, a modified alkyd polymer, an allyl diglycol carbonate polymer, a polybutadiene or substituted polybutadiene polymer, an unsaturated polyester, a polyimide, a silicone polymer, a silicone polyimide copolymer, or a combination comprising any of the foregoing.

9. The method of claim 1, wherein the elastomer band comprises a polymer or copolymer comprising vinyl chloride monomer repeat units.

10. The method of claim 1, wherein the elastomer band is substantially free of phthalate plasticizers.

11. The method of claim 1, wherein the unstretched elastomer bands have cross sectional dimensions of from about 2 mm to about 7 mm.

12. The method of claim 1, wherein the unstretched elastomer bands have a generally rectangular vertical cross section with each side of the generally rectangular vertical cross section having dimensions of about 1 mm to about 7 mm.

13. The method of claim 1, wherein the unstretched elastomer bands have a generally rectangular vertical cross section with a height of about 1 mm to about 30 mm.

* * * * *